US010750592B1

(12) United States Patent
Price et al.

(10) Patent No.: US 10,750,592 B1
(45) Date of Patent: Aug. 18, 2020

(54) SYSTEMS AND METHODS FOR CONTROLLING COLOR TEMPERATURE AND BRIGHTNESS OF LED LIGHTING USING TWO WIRES

(71) Applicant: Hardware Resources, Inc., Flower Mound, TX (US)

(72) Inventors: Greg Price, Hampstead, NC (US); Gong Fei, Shenzhen (CN)

( * ) Notice: Subject to any disclaimer, the term of this patent is extended or adjusted under 35 U.S.C. 154(b) by 0 days.

(21) Appl. No.: 16/696,938

(22) Filed: Nov. 26, 2019

Related U.S. Application Data

(63) Continuation-in-part of application No. 16/513,507, filed on Jul. 16, 2019, now Pat. No. 10,721,801.

(30) Foreign Application Priority Data

Jun. 5, 2019 (CN) ..... 2019 10 4845616

(51) Int. Cl.

| | |
|---|---|
| ***H05B 45/20*** | (2020.01) |
| ***H05B 45/37*** | (2020.01) |
| ***H05B 45/44*** | (2020.01) |
| ***H05B 45/42*** | (2020.01) |

(52) U.S. Cl.
CPC ..... *H05B 45/20* (2020.01); *H05B 45/37* (2020.01); *H05B 45/42* (2020.01); *H05B 45/44* (2020.01)

(58) Field of Classification Search
CPC ..... H05B 33/086; H05B 33/0815; H05B 33/0824; H05B 33/0806; H05B 33/0809; H05B 33/0818; H05B 33/0821; H05B 33/0827; H05B 33/0842; H05B 33/0845; H05B 37/02; H05B 37/0281; F21Y 2113/17
See application file for complete search history.

(56) References Cited

U.S. PATENT DOCUMENTS

| | | | | |
|---|---|---|---|---|
| 10,136,485 | B1 * | 11/2018 | Coetzee | H05B 33/0809 |
| 2006/0050543 | A1 * | 3/2006 | Chan | H02M 1/08 363/132 |
| 2006/0262581 | A1 * | 11/2006 | Lin | H02M 7/53871 363/132 |
| 2014/0333219 | A1 * | 11/2014 | Zijlstra | H05B 33/0809 315/192 |
| 2017/0347411 | A1 * | 11/2017 | Gallo | H05B 33/0818 |

OTHER PUBLICATIONS

Swagatam; H-Bridge Inverter Circuit Using 4 N-channel Mosfets; https://www.homemade-circuits.com/h-bridge-inverter-circuit-using-4-n/#llc_comments ; Mar. 20, 2019 (Year: 2019).*

* cited by examiner

*Primary Examiner* — Renan Luque
(74) *Attorney, Agent, or Firm* — Bell Nunnally & Martin LLP

(57) ABSTRACT

Electronic circuitry for independently adjusting color temperature and brightness of an LED light fixture is disclosed utilizing two wires. According to one embodiment, a color-tunable and dimmable LED light fixture has first and second LED light strings connected in an anti-parallel arrangement.

19 Claims, 16 Drawing Sheets

PWM
401
402
403
VCC
VCC
VCC
Q13
Q6
Q9
Q8
Q10
Q11
Q12
Q5
Q7
Q3
Q4
Q1
Q2
R1
R2
R3
R4
R5
R6
R7
R8
R9
R10
R11
R12
R13
R14
R15
R16
R17
R18
R19
R20
D1
D2
D3
D4
D5
D6
D7
D8
D9
D10
D11
D12
D13
D14
D15
D16
D17
D18
D19
D20
D21
D22
D23
D24
D25
D26
D27
D28
D29
D30
D31
D32
D33
D34
D35
D36
D37
D38
D39
D40

700

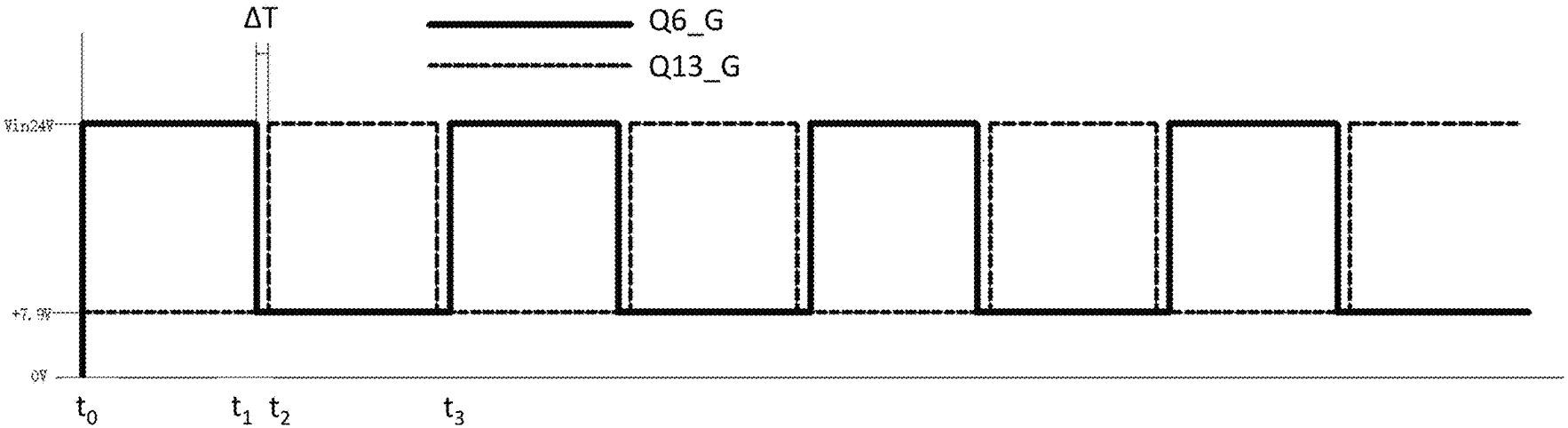
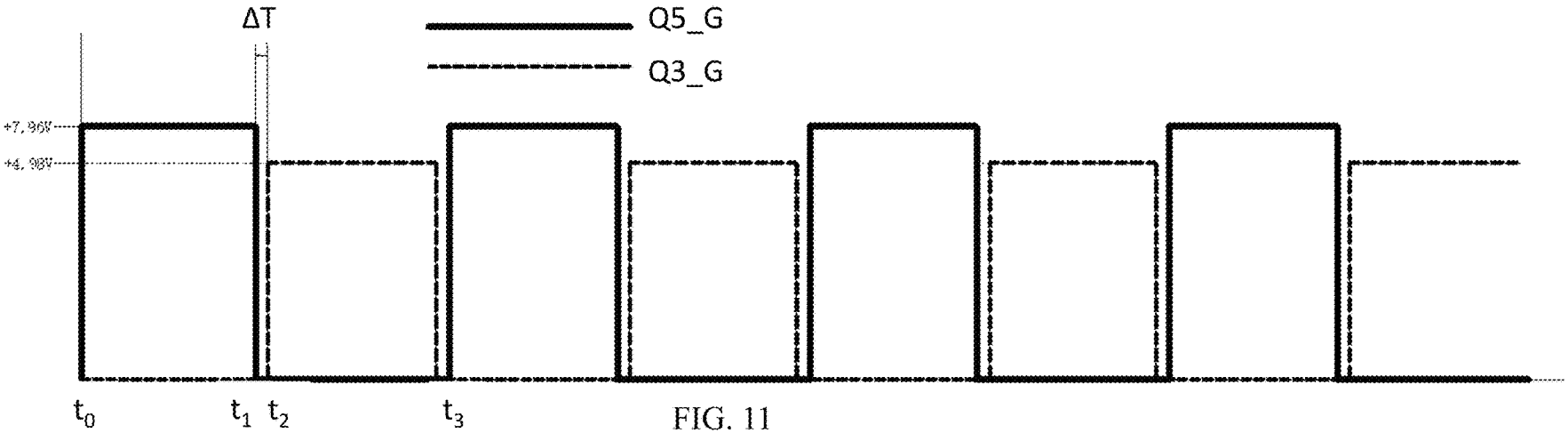
FIG. 11

SYSTEMS AND METHODS FOR CONTROLLING COLOR TEMPERATURE AND BRIGHTNESS OF LED LIGHTING USING TWO WIRES

CROSS-REFERENCE TO RELATED APPLICATIONS

The present application is a continuation-in-part of U.S. patent application Ser. No. 16/513,507, filed Jul. 16, 2019, entitled "Systems and Methods for Controlling Color Temperature and Brightness of LED Lighting Using Two Wires," which claims priority to Chinese Patent Application Serial No. CN2019104845616, filed Jun. 5, 2019, entitled "System for adjusting the color temperature and brightness of an LED light source," all of which are hereby incorporated by reference for all purposes.

BACKGROUND

Technical Field

The invention generally relates to light emitting diode (LED) light fixtures, and more specifically pertains to electronic circuitry for controlling color temperature and brightness of LED lighting using two wires.

Background

The concept of color temperature is based on the comparison of a visible light source to that of an ideal black-body radiator. The color temperature (CT) scale assigns numerical values to the color emitted by the black-body source, measured in degrees Kelvin (K). The CT scale typically ranges from, for example, 5000-6500 K for "Daylight White," 3500-5000 K for "Cool White," and 3500 K and below for "Warm White." White light-emitting diodes (LEDs) are measured according to a correlated color temperature (CCT) scale, which is adjusted according to human perception. The terms CCT, color, and spectrum are often used interchangeably to refer to the spectrum of light emitted by an illumination source.

It is well-known that the color of the light produced by incandescent lamps changes when the lamp is dimmed. When an incandescent lamp is at full rated power, its CCT is usually within the range of 2700 K-3300 K. However, when the incandescent lamp is dimmed, the CCT changes to as low as 1700 K. To the human eye, the incandescent bulb appears to go from white to yellow, giving off a warm glow when dim. For many years, this inherent characteristic of incandescent bulbs has been used with dimmers to create a warm and cozy environment in homes, restaurants, and other places.

LED light fixtures, which are more energy efficiency that incandescent bulbs, give off light that does not normally change color when dimmed. Conventionally, lighting systems featuring LEDs or other illumination sources may be dimmed using any of a variety of techniques, such as increasing or decreasing the power to the LEDs or modulating the power to the LEDs using, for example, pulse-width modulation (PWM). However, the white light from an LED light source maintains a constant CCT when dimmed, which may be perceived as cold and unnatural rather than warm and cozy. LED lighting manufacturers are continually trying to find ways to duplicate the warm glow of dimmed incandescent bulbs in a cost-effective manner.

One way to simulate the warming-with-dimming characteristic of an incandescent lamp with an LED light source is to optically mix Cool White LEDs with Warm White LEDs, and control their currents in such a manner that the mixed light from the LED combination can be changed from Cool White to Warm White. Controlling the relative outputs of the different sources allows the user to obtain the CCT of one or the other of the LEDs or a mixed combination of both. This process is often called color mixing or color tuning.

Traditionally, LED systems performing mixing of two or more colored LEDs use individual drivers controlling each colored LED separately or a single driver designed to have two or more separate output channels, where each output channel is controlled individually within the driver. For example, U.S. Pat. No. 7,288,902 to Melanson, which is incorporated herein by reference, describes such a circuit having multiple light sources to vary the color temperatures in response to changing dimming levels. When powered, the first LED string radiates light at a first CCT and the second LED string emits light at a second CCT. A first power supply is required to supply power to the first LED string and a second power supply is required to supply power to the second LED string. The light source driver provides individual drive currents to each light source in response to the selected dimming level and color temperature. To adjust the color of the overall output of the LED strings, the outputs of the power supplies are raised or lowered relative to each other. Thus, to independently control the two LED strings, this solution requires at least two power supplies and at least four wires coupling the power supplies to the LED strings. In such an embodiment, at least a two-channel LED driver must be used to power the Warm White LED array in addition to the Cool White LED array. The use of multiple LED drivers or a multi-channel output LED driver to control multiple LED arrays has several disadvantages including, for example, increased cost and complexity.

One solution for reducing the complexity of the circuitry needed to achieve color mixing that has been introduced recently is to provide two LED strings connected in an anti-parallel arrangement. For example, U.S. Pub. Pat. App. No. 2012/0206065 to Whitaker et al., which is incorporated herein by reference, describes a light emitting apparatus and method of manufacturing and using the same. As another example, WO2016/131558 to Istvan Bakk, which is incorporated herein by reference, describes a color-tunable LED module with anti-parallel LED strings. As another example, U.S. Pat. No. 10,136,485 to Coetzee, which is incorporated herein by reference, describes a method for adjusting the lighting output of illumination systems. In that solution, the overall optical characteristic and intensity of light emitted by at least two LED stings may be independently controlled by selectively activating each LED string over multiple time intervals. However, the circuitry for adjusting the brightness and color output of the LED arrays in that solution has several limitations and drawbacks. For example, the circuitry proposed in that solution requires an integrated circuit (IC) to control the voltage and will not work for large loads, such as, for example, when multiple LED strings are coupled to the LED driver or each LED strings contains a high number of LEDs.

Some of the limitations and drawbacks of these solutions will be illustrated with reference to FIG. 14, which is a schematic of a prior art bridge circuit. In FIG. 14, the bridge circuit shown has four N-channel Metal Oxide Semiconductor Field Effect Transistors (MOSFET) with the D-poles of the upper-bridge N-channel MOSFETs connected to a positive pole and the S-poles of the lower bridge N-channel MOSFETs connected to a negative pole. By way of example, FIG. 15 illustrates the drive waveform for the two NMOS transistors of the upper half bridge of the bridge shown in FIG. 14 in normal operation. By way of further example, FIG. 16 illustrates the drive waveform of an NMOS transistor of the upper half bridge and a corresponding NMOS transistor of the lower half bridge of the bridge shown in FIG. 14 in normal operation. In this configuration, the voltage of the S-poles of the upper bridge MOSFETs will be equal to the Battery voltage, and the driver has performed a bootstrap process to ensure that the G-pole voltage of the upper bridge MOSFETs can be greater than the voltage of the Battery to ensure its normal conduction. Since the upper bridge driving voltage is boosted via the bootstrap, the gate driving voltage of the two NMOS transistors on the upper bridge is higher than the highest amplitude voltage of the power supply loop. The magnitude of the boost would thus need to combine the parameters of Vgs of the power supply loop and the MOSFETs.

Thus, there is a need for an improved solution for controlling the optical characteristics of light emitted by an LED lighting system.

SUMMARY OF THE INVENTION

The present invention relates in general to the field of LED lighting systems. In various embodiments, systems and methods are provided for adjusting the color temperature and brightness of an LED light source using two wires. According to one embodiment, a dimmable and color-tunable LED light fixture is disclosed, which comprises first and second LED light sources connected in an anti-parallel arrangement, wherein the first LED light source produces light visibly different in color from that of light produced by the second LED light source. In one embodiment, the first LED light source emits light with a first color temperature and the second LED light source emits light with a second color temperature. The first and second LED light sources are connected to an LED driver using only two wires, wherein the LED driver is configured to output a DC voltage switched between two polarities. In various embodiments, the ratio of the time period of a first polarity compared to the time period of a second opposite polarity is adjustable. In some embodiments, a control unit may determine a duty-cycle ratio to achieve a desired color temperature and then reduce the duty-cycle ratio to achieve a desired brightness and output one or more control signals to the LED driver.

Due to visual persistence of human eyes, the human eyes may perceive a mixed color temperature state, when the two color temperatures do not appear at the same time. As the time period of the visual persistence of human eyes is generally between 0.1 sec to 0.4 sec, it thus can ensure a change of color temperature perceived in most human eyes when the control signal is above 20 Hz. Of course, in actual use, in order to obtain a more natural and smooth saturation state, the frequency will often be much higher than 20 Hz.

The LED driver can change the polarity of the power supplied to the LED strings according to the duty cycle based on the one or more control signals. The control unit may vary the duty cycle of each polarity based on the desired color temperature and/or brightness. In various embodiments, the color-tuning and dimming is achieved by modulation of the electrical supply to the LED light sources without the requirement of an additional connection for supplying color tuning or dimming signals. According to one aspect, the dimmable and color tunable LED lighting system does not need to have an individual LED driver for each LED light source, or have a multi-channel output LED driver, to control the Cool White and Warm White LED arrays separately.

In accordance with certain embodiments, methods and systems are provided for adjusting, independently and/or simultaneously, the CCT and overall light output of an LED lighting systems with multiple LED strings having different illumination properties. Various embodiments may reduce the cost and complexity of a dimmable, color-tunable lighting system by using an array of switches to achieve pulse-width modulation of power supplied by a single, constant-output power supply to a plurality of LED strings.

In one embodiment, the lighting system includes a two-pin (i.e., two wire) LED driver to provide dynamic white tunable CCT LED lighting control. In some embodiments, a controller may send a control signal to the LED driver based on the IEEE 802.15.4 wireless standard, Zigbee, Z-wave, and radio frequency (RF), and/or other methods of control, to simultaneously and/or independently adjust the brightness and Kelvin temperature of a plurality of LED strings. It various embodiments, the lighting system may also be utilized to control LED strings having various optical characteristics including, but not limited to, red, green, blue, white, and/or CCT.

In various embodiments, an illumination system is provided having a power supply, a first LED string, a second LED string anti-parallel to the first LED string (i.e., connected in parallel but with opposite polarities), and a switch array, wherein the first LED string is configured to emit light of a first optical characteristic and the second LED string is configured to emit light of a second optical characteristic different from the first optical characteristic. In various embodiments, the switch array may be configured as an H-bridge circuit. The switch array may be configured to selectively electrically couple the power supply to the first and second LED strings at a frequency greater than the flicker fusion threshold of human vision, so that apparently smooth, uninterrupted illumination may be provided as the LED strings are switched on and off. The switch array may be configured to selectively electrically couple the power supply to the first and second LED strings, thereby enabling the selection of an overall optical characteristic of light emitted by the lighting system by alternately forward biasing the first LED string and reverse biasing the second LED string or reverse biasing the first LED string and forward biasing the second LED string. The switch array may also be configured to dim the overall intensity of the light emitted by the lighting system, independent of the overall optical characteristic of the light emitted by the lighting system, by selectively disconnecting both the first and second LED strings from the power supply. The first and second LED strings may each comprise multiple LEDs connected in series and/or parallel and/or may each comprise multiple LED strings connected in series and/or parallel.

According to one embodiment, a color tunable and dimmable LED driver circuit is disclosed for controlling the light emitted from first and second LED light sources. The LED driver circuit may include a MOSFET bridge circuit to periodically switch the supply voltage to the LED strings with different polarity depending on a control signal. In various embodiments, the MOSFET bridge comprises two NMOS transistors and two PMOS transistors. In some embodiments, the NMOS transistors may be disposed on the low side of the LED strings and the PMOS transistors may be disposed on the high side of the LED strings. In such an embodiment, to provide the supply voltage to the first LED light source, a first NMOS transistor and a first PMOS transistor may be activated and a second NMOS transistor and a second PMOS transistor may be deactivated. To provide the supply voltage to the second LED light source, the first NMOS transistor and the first PMOS transistor may be deactivated and the second NMOS transistor and the second PMOS transistor may be activated. In various embodiments, only one pair of NMOS and PMOS transistors may be active at the same time. In such embodiments, additional circuitry may be provided to activate corresponding MOSFETs and deactivate the other MOSFETs to ensure only one pair is active at the same time.

The above summary of the invention is not intended to represent each embodiment or every aspect of the present invention. Particular embodiments may include one, some, or none of the listed advantages. The foregoing and additional aspects and embodiments of the present invention will be apparent to those of ordinary skill in the art in view of the detailed description of various embodiments and/or aspects, which is made with reference to the drawings, a brief description of which is provided next.

BRIEF DESCRIPTION OF THE DRAWINGS

A more complete understanding of the method and apparatus of the present invention may be obtained by reference to the following Detailed Description when taken in conjunction with the accompanying Drawings wherein:

FIG. 11 depicts waveforms of the adjustment topology for driving the four switches;

DETAILED DESCRIPTION

Figure 1:
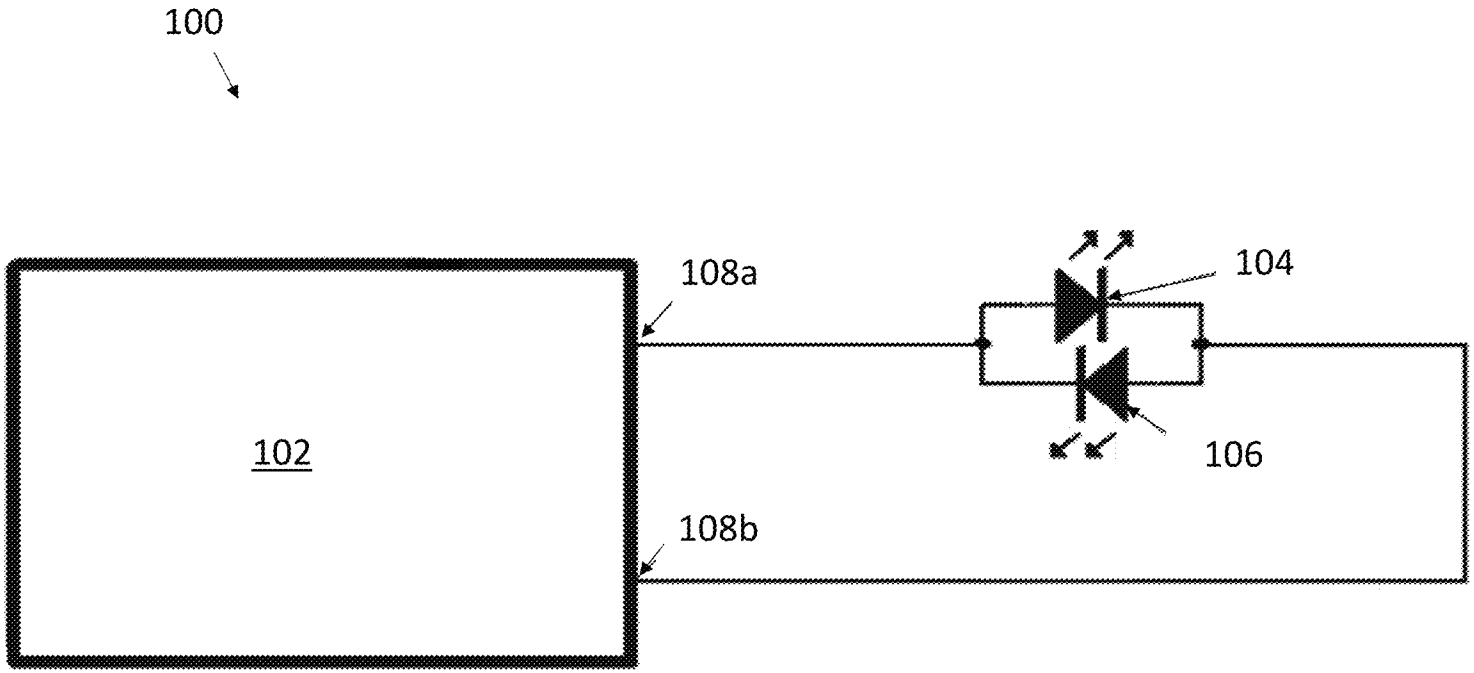
FIG. 1 is an electrical block diagram of a dimmable and color tunable LED light fixture in accordance with an embodiment of the present disclosure.

The present invention is directed towards systems and methods for controlling color temperature and brightness of LED lighting using two wires. Referring now to FIG. 1, a block diagram of a dimmable LED light fixture 100 is shown. Fixture 100 is connected to an AC or DC power source (not shown), which may be 110-120 VAC (often used in the United States), 220-240 VAC (often used outside the United States), 12 VDC, 24 VDC, or other source of direct or alternating current. However, the fixture 100 may be coupled to any power source. LED driver 102 is shown connected to two LEDs 104 and 106 via only two wires coupled to two output terminals 108*a* and 108*b* in this block diagram. As shown in FIG. 1, LED 104 and LED 106 are connected in an anti-parallel arrangement. The LED driver 102 provides control of the color temperature and brightness of the LEDs 104 and 106 via the two output terminals, 108*a* and 108*b*.

Figure 2B:
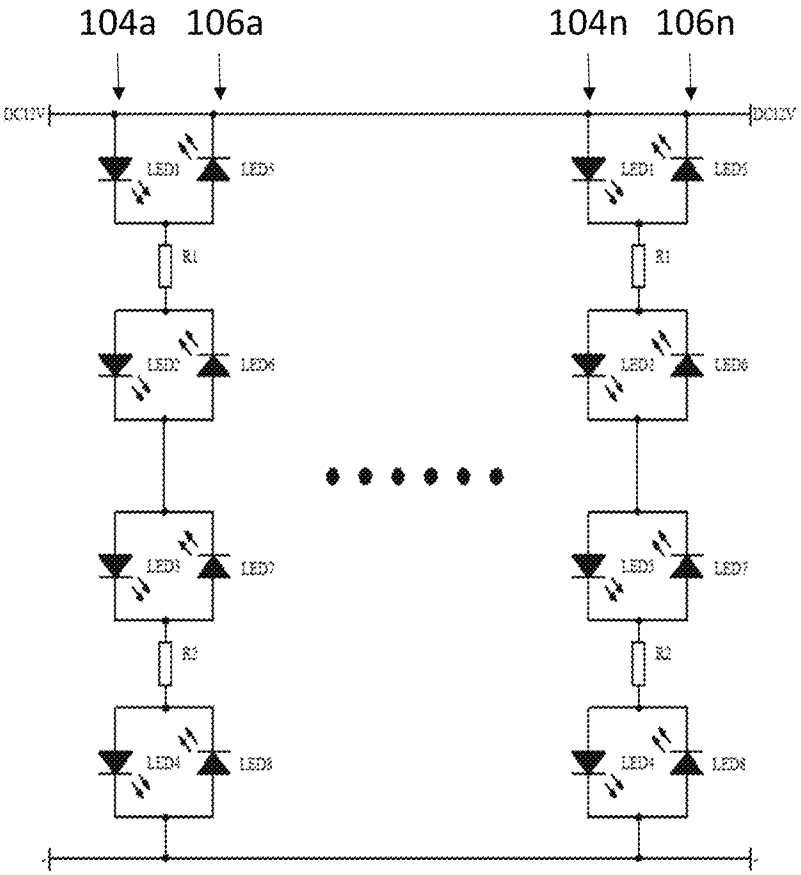
FIGS. 2A and 2B are an electrical block diagrams of exemplary embodiments of two or more LED strings connected in an parallel and/or anti-parallel arrangement.
Figure 2A:
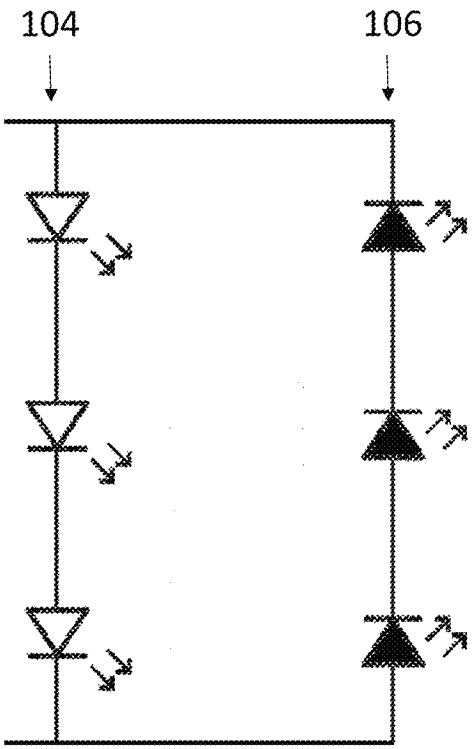

Referring now to FIGS. 2A and 2B, various embodiments of LEDs 104 and 106 are shown. As shown in FIG. 2A, in some embodiments, LEDs 104 and 106 may each comprise a plurality of LEDs (3 LEDs each shown in FIG. 2A) coupled together in series. As shown in FIG. 2B, LED 104 may comprise a plurality of LEDs in series (shown as LED1-LED4) and may comprise a plurality of LED strings in parallel (shown as 104*a* and 104*n*). Similarly, LED 106 may comprise a plurality of LEDs in series (shown as LED5-LED8) and may comprise a plurality of LED strings connected in parallel (shown as 106*a* and 106*n*) to each other, but connected anti-parallel to LED strings 104*a*-104*n*. An LED array may refer to any independently powered and/or controlled group of one or more LEDs. An LED may be a light-emitting diode or any light-emitting device capable of performing the functions described herein. A string of LEDs may refer to a group of one or more LEDs connected in series or two or more such series-connected LED groups connected in parallel and, in various embodiments, having similar spectral properties. For example, a number of LED groups wired in parallel and switched on and off together may be considered a single string. As shown in FIG. 2B, each LED string may include any number of LEDs with or without resistors therebetween.

Figure 3:
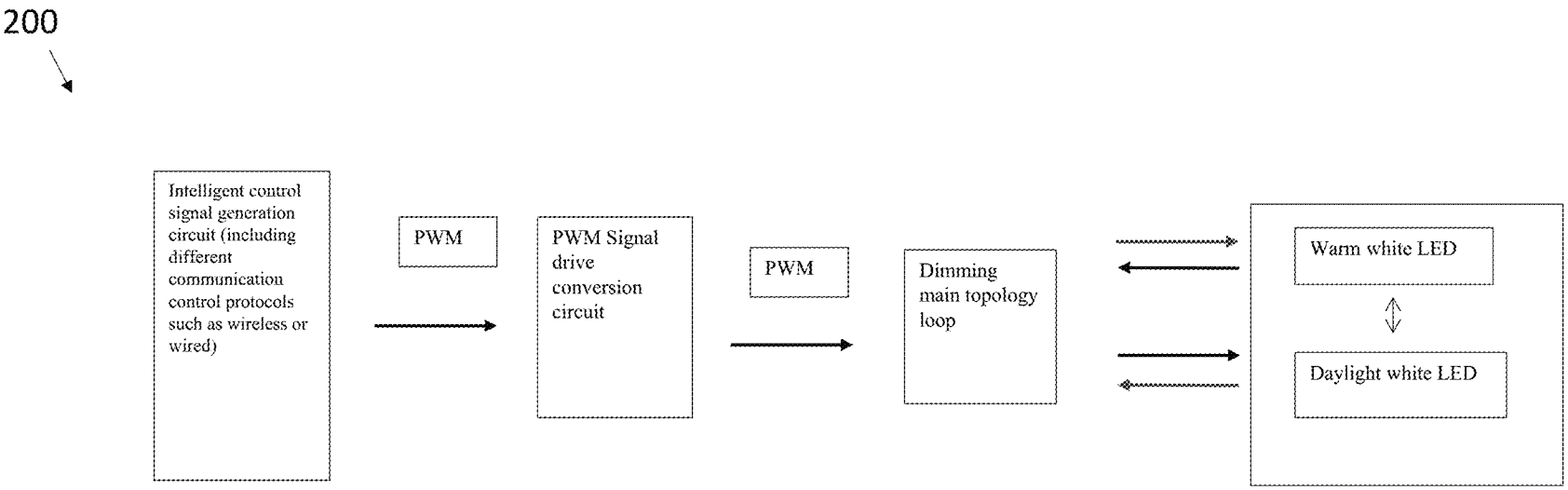
FIG. 3 is a block diagram of the control signals for controlling the LED light fixture.

Referring now to FIG. 3, a block diagram 200 of the control signals for controlling the LED light fixture is provided comprising three parts: an intelligent control signal output part; an intelligent signal driving part; and an intelligent dimming main topology circuit part. For the intelligent control signal output part, it may be Z-wave, ZigBee, WiFi, Bluetooth, Lora, and/or other wireless signals, or KNX, DMX, DALI and/or other wired signals. In various embodiments, an intelligent control signal generation circuit creates a control signal based on a desired color temperature and brightness. The control signal may determine a ratio of first LED activation to second LED activation for a desired color temperature. The ratio may then be reduced proportionally for a desired brightness. The control signal is then sent to the LED driver which then powers a number of LED strings connected in parallel to the LED driver using two wires. The LED driver is arranged to control electrical conduction between a power supply and wires that supply power to at least two LED strings in an antiparallel arrangement. In various embodiments, each LED is capable of being switched on and off at a rate faster than the flicker fusion threshold of human vision, so that apparently smooth, uninterrupted illumination may be provided as the LEDs are switched on and off. In various embodiments, the LEDs have two or more distinct CCTs or colors. In various embodiments, the switches are opened and closed in a manner that enables the overall light intensity of the LED and the overall color of the light output of the LED to be adjusted within certain bounds. Specifically, in a first subinterval of time, while a first LED string is switched on, a second LED string is switched off; in a second subinterval of time, the second LED string is switched on and the first LED string is switched off; and so forth for some number of subintervals of time. A periodic series of such patterns of illumination may be produced. Due to the time-averaging properties of human vision, perceived illumination color will depend on the relative amounts of time that some colors are switched on and the amounts of time that other colors are switched on. Moreover, including subintervals of time in which all the LEDs are switched off will reduce the time-averaged (and thus perceived) brightness of the illumination. Both color mixing and dimming may be achieved by appropriate manipulation of the switches in the LED driver.

By forcing currents of varying pulse widths, and direction, through the load, independent control of the light output intensity of each of the antiparallel strings of LEDs, as well as the overall intensity of the combined LED load, is achieved. As described herein, in various embodiments, the anti-parallel strings of LEDs may have different colors, permitting mixing or tuning of the perceived color of the lighting system. In some embodiments, the anti-parallel strings of LEDs may have other differences and varying the current to each of the anti-parallel strings may permit variation or tuning of these characteristics. As discussed herein, switch arrays may be configured to control more than two groups of LEDs, and such switch arrays may be used to vary or tune one or more optical parameters between three or more characteristics of each group or string of LEDs operating individually.

The color temperature is determined by the on-duty ratio of the cool white LEDs to the warm white LEDs. In various embodiments, the overall duty cycle may be reduced slightly to, for example, 90% due to inherent delays of the circuitry. When the brightness is adjusted for a certain color temperature, the on-duty ratio of cool white and warm white is proportionally reduced to achieve brightness adjustment. Although cool white and warm white are not turned on at the same time, the speed of adjusting the switch is faster than the time that the human eye can distinguish.

Figure 4:
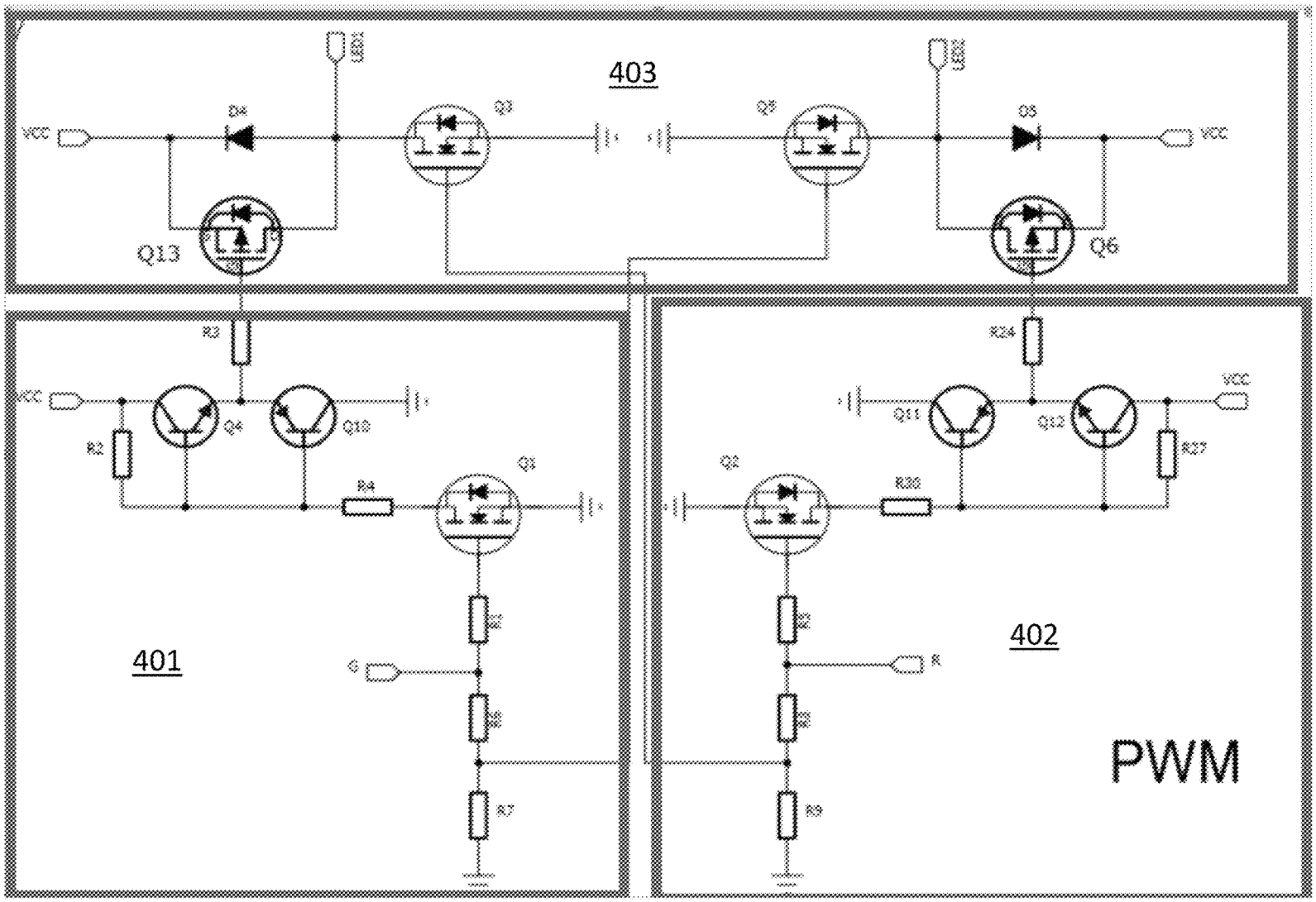
FIG. 4 is a schematic of an LED driver for controlling the LED light fixture.

Referring now to FIG. 4, circuitry for an LED driver 400 is provided using at least two PMOS transistors (Q13 and Q6) and at least two NMOS+ transistors (Q3 and Q5). The PMOS transistors control the high-end drive turn-off function while the NMOS+ transistors control the low-end drive turn-off function. Using two NMOS transistors and two PMOS transistors provides benefits over prior art devices that use, for example, four NMOS transistors. For example, in some embodiments, using PMOS transistors provides enhanced noise immunity. For NMOS transistors, the voltage at the gate needs to be higher than the $V_{in}$ in order to turn on. Thus, using PMOS transistors on the high side avoids the need for fully-floating gate driver as needed when NMOS transistors are utilized on the high side. Additionally, using both NMOS and PMOS transistors means the circuitry is utilizing both electrons (N-type) and holes (P-type) as carriers, which provides the benefits of the speed of the electron carriers (NMOS) and the immunity to noise (PMOS). The warm white and cool white are alternately turned on to realize the color temperature and brightness adjustment through two sets of PWM waveforms. In use, the intelligent control signal from the controller includes G and R signals, which are the output PWM signal of the controller, which is the control signal for controlling the warm white and cool white LEDs. In the figure, the control circuitry contained within subpart 401 controls PMOS Q13 and NMOS Q5 to ensure staggered conduction. In the figure, the control circuitry contained within subpart 402 controls PMOS Q6 and NMOS Q3 to ensure staggered conduction. In the figure, the circuitry contained within subpart 403 is the LED conduction circuit. Q13 and Q5 are grouped together, and Q6 and Q3 are grouped together, which control the conduction of LED1 and LED2 respectively. When the signal G is at a high level, it passes through the gate electrode of R6 to NMOS Q5, which will activate it. The G signal will also pass through R1 to activate NMOS Q1. By activating NMOS Q1, a low level signal will pass through R3 to Q13 by the push-pull output of complementary transistors Q4 and Q10. Since Q13 is a PMOS, the low level signal will activate Q13. Activating Q13 and Q5 results in illumination of LED1. When signal G is at a low level, Q5 and Q13 will be turned off resulting in the de-illumination of LED1. The control circuitry contained within subparts 401 and 402 are symmetrical and the principle of signal control conduction will be essentially the same. Thus, when the signal R is at a high level, Q6 and Q3 will be activated resulting in illumination of LED2 and when the R signal is low, Q6 and Q13 will be deactivated resulting in the de-illumination of LED 2.

In operation, the G and R signals are alternately given a high level as follows: in one cycle, the color temperature may be adjusted by controlling the ratio of high level of G and R, such as, for example, G high for 10% and R high for 80%, G high for 20% and R high for 70%, G high for 80% and R high for 10%, etc. In various embodiments, a margin may be built into the duty cycle, such as, for example 10%. Once the ratio for color temperature is determined for one duty cycle, the brightness may be adjusted by proportionally reducing the duty cycle for that color temperature. For example, for a color temperature where G is high for 45% and R is high for 45%, the overall light output may be reduced by reducing the duty cycle to where G is high for 40% and R is high for 40%, G is high for 5% and R is high for 5%, etc. It should be noted that when the color temperature is at or near the lower or upper limits of the CCT, when adjusting the brightness, the signal with the smaller duty should be taken as the standard. For example, for a 10% and 80% ratio, reducing the brightness of both by 10% would extinguish the LED that was only on for 10% of the duty cycle, resulting in the light output being all warm white or all cool white. Therefore, near the upper or lower limits, the duty cycles should be reduced proportionally to avoid extinguishing one of the LED strings altogether.

In various embodiments, the control circuits 401 and 402 may be modified to other circuitry capable of providing the appropriate control signals to the LED conduction circuit 403. In addition, if the LED conduction circuit 403 is modified, appropriate changes to the control circuits 401 and 402 may also be necessitated. Various other implementations of the circuitry are contemplated to achieve the cold white and warm white drive signals to achieve two-wire control of the two different LED strings.

Figure 5:
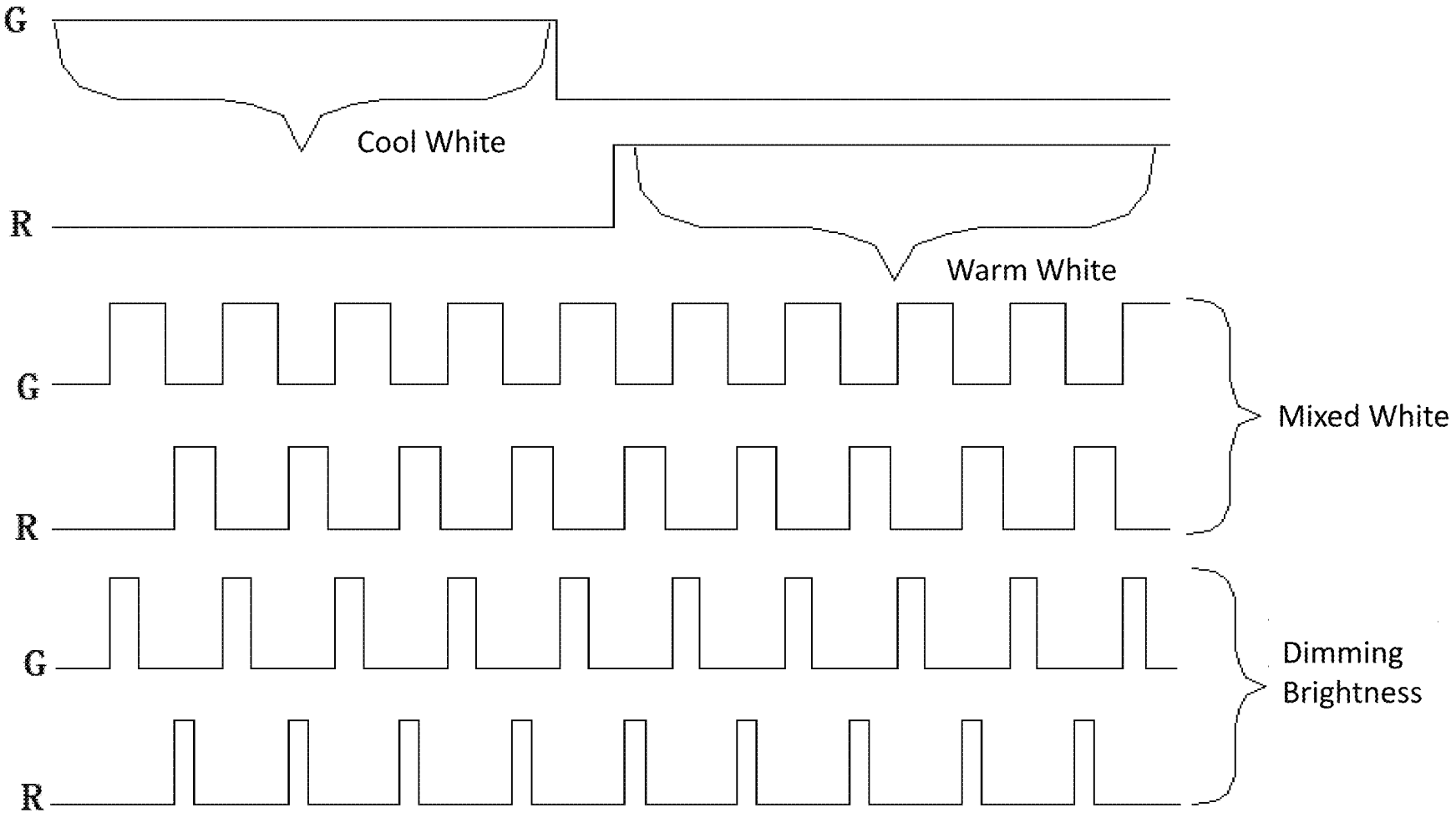
FIG. 5 depicts switch states as a function of time for controlling color temperature and brightness of LED lighting using two wires.

FIG. 5 shows a graph of exemplary ratios of the duty cycles for the G and R signals for various color temperatures and brightness. In the first two rows, the G signal is on providing Cool White light, both G and R are off for a short period of time, and then the output is switched to the R signal being on to provide Warm White light. In the third and fourth rows, the G and R signals are switched off and on to provide Mixed White light. In the fifth and sixth rows, the G and R signals are reduced proportionally to dim the overall brightness of the light while maintaining the Mixed White light.

Figure 6:
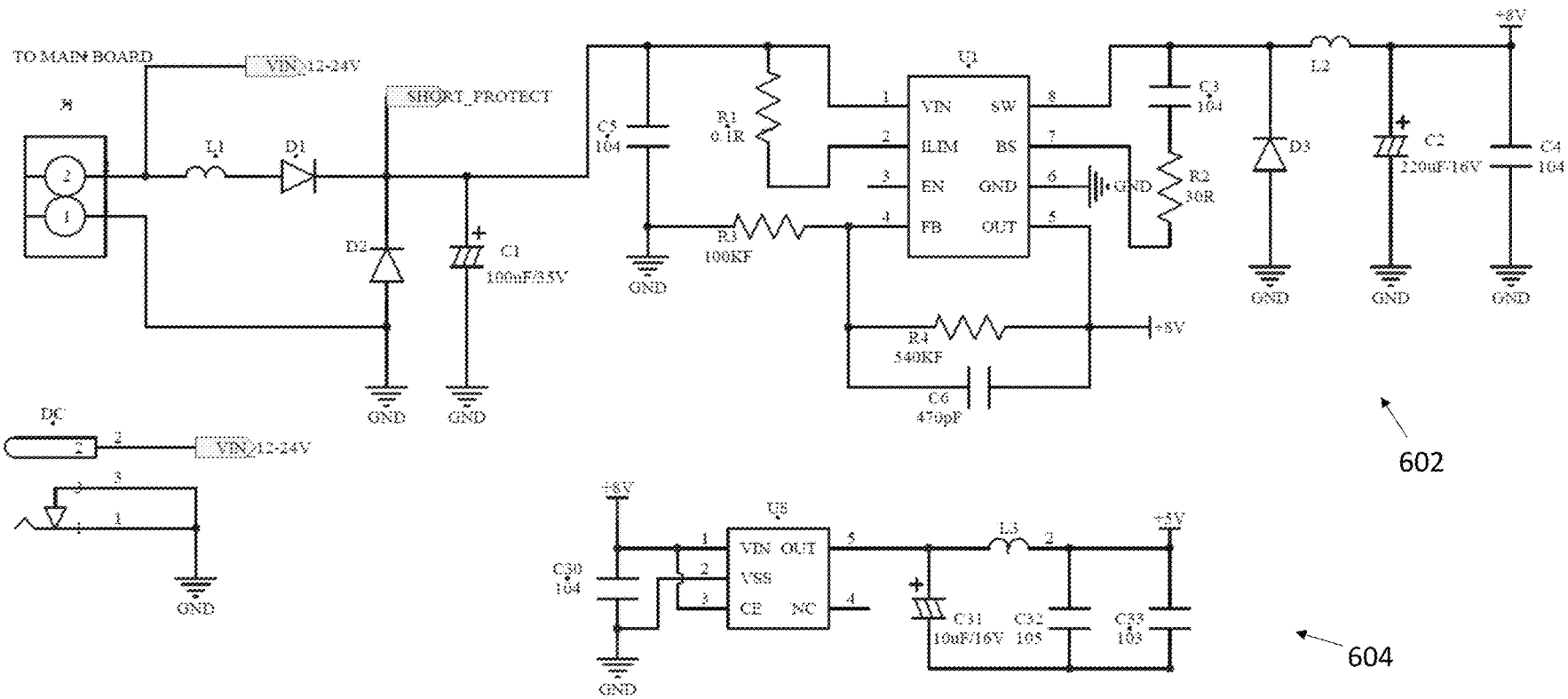
FIG. 6 is a schematic of a power supply circuit for the LED light fixture.

Turning now to FIG. 6, a schematic of an embodiment of a power supply circuit 600 for providing power to the control circuitry is shown. As shown in FIG. 6, $V_{in}$ (12-24V) is a DC input voltage for the entire power supply system, which is also a power supply input voltage for lighting up the LED lamp (i.e., the load). A first driver voltage (+8V) signal is supplied after a DC-DC conversion via, for example, circuitry 602, and a second driver voltage (+5V) signal is supplied from the first driver voltage (+8V) via, for example, a Low-Dropout Regulator ("LDO") 604. Thereby providing the drive power signals for the various bridges.

Figure 7:
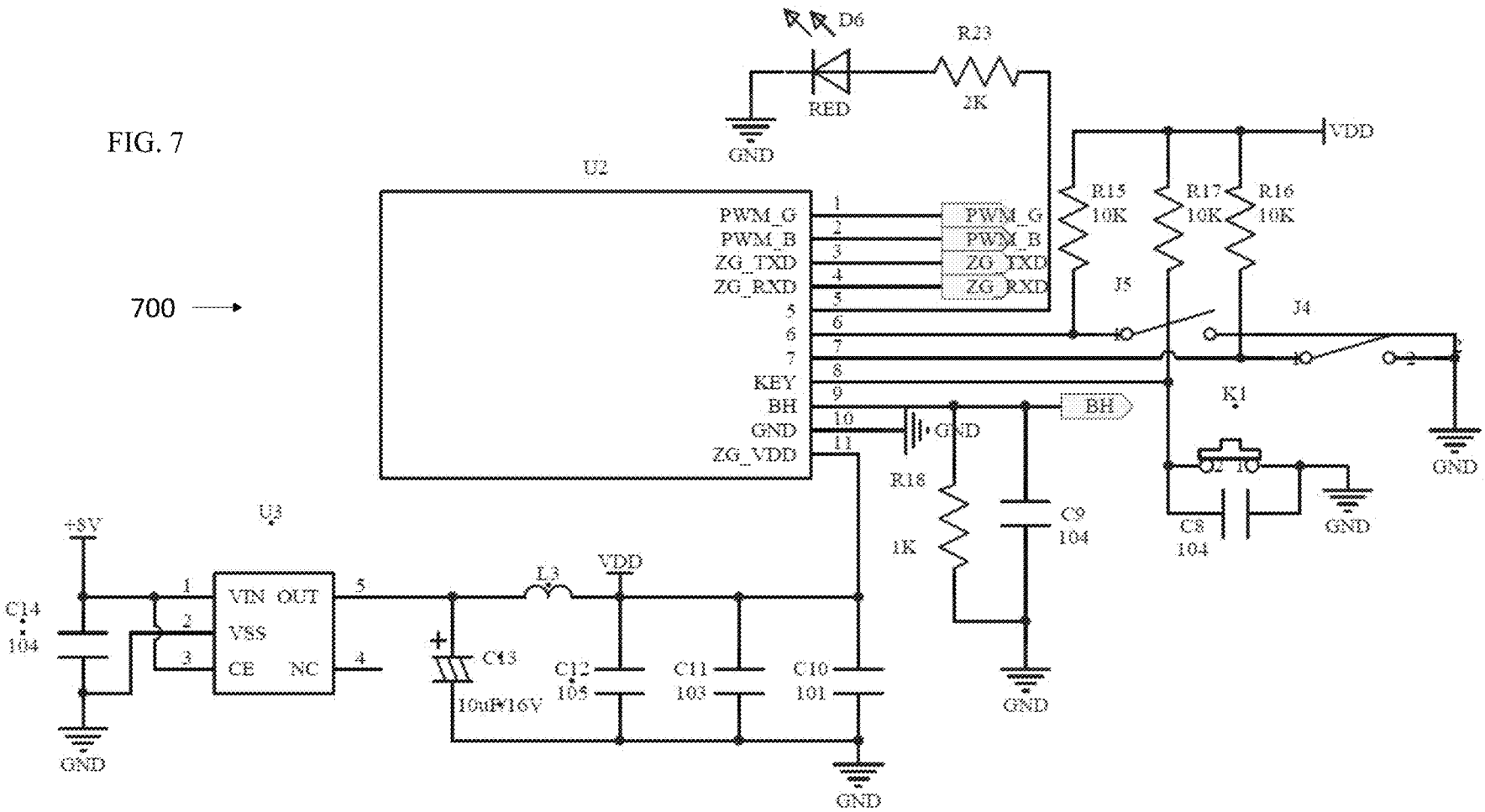
FIG. 7 is a schematic of a wireless control circuit for the LED light fixture.

Turning now to FIG. 7, a schematic of an embodiment of an intelligent control signal generation circuit 700 is provided. This intelligent controller receives a signal from a radio module, for example a ZigBee module, and outputs PWM_G and PWM_B signals for adjusting the color temperature and brightness. As explained in more detail below, the output signals can be used to control the drive circuitry to obtain different ratios of warm and cool white light and different duty cycles, such that the color temperature and brightness may be varied.

Figure 8:
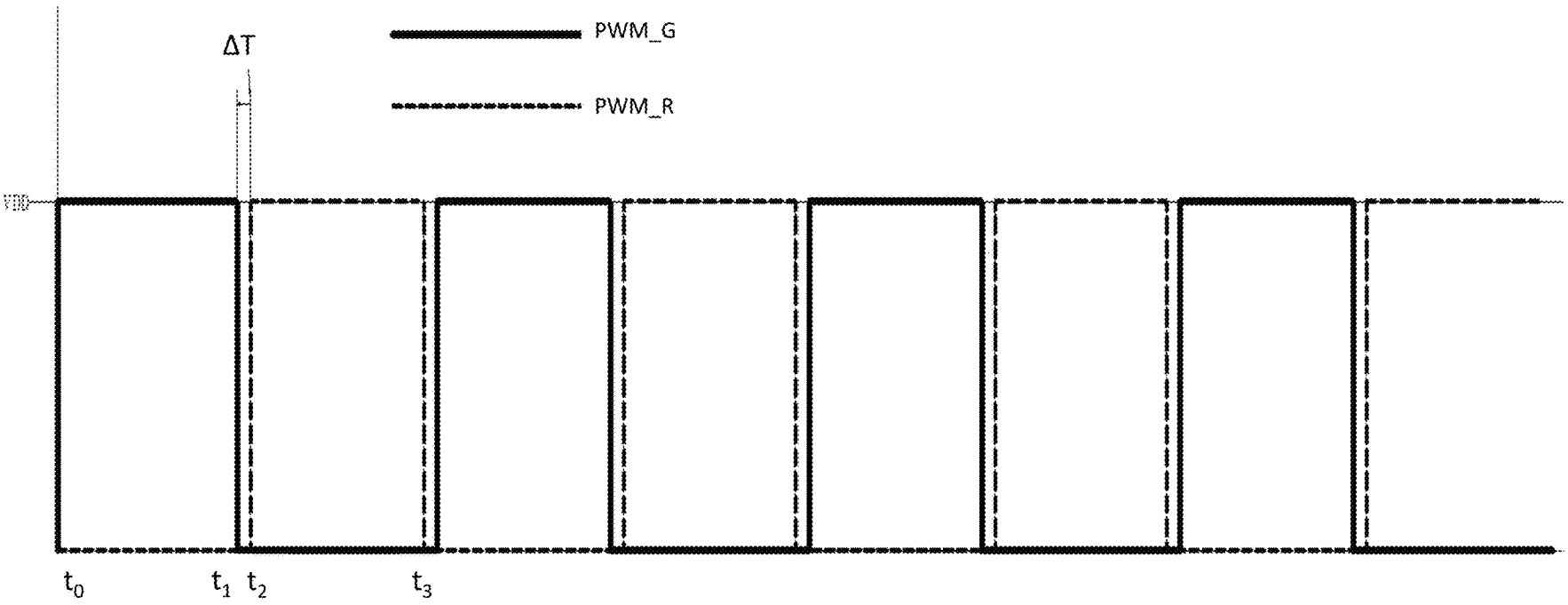
FIG. 8 depicts a PWM signal generated by a microcontroller unit of the LED light fixture.

Referring now to FIG. 8, exemplary waveforms generated by the intelligent control signal generation circuit (the "MCU") are provided. The waveforms are the PWM signals generated by the MCU having an amplitude of VDD. The example waveforms shown in FIG. 8 will be used to illustrate that the total time of the warm and cold phases will be less than 100% of the total period of each cycle. At time $t_1$, PWM_G is turned off, and at time $t_2$, PWM_R is turned on, $\Delta T=t_2-t_1$, where $\Delta T$ is a time difference between switching off warm light and switching on cold light, or between switching off cold light and switching on warm light. Due to the existence of this time difference, the total time of warm and cool phases during dimming is less than 100% of the total period. Where, $t_1-t_0=\Delta T_1$, $t_3-t_2=\Delta T_2$, $\Delta T_1/\Delta T_2=K$, K is a constant value at a certain color temperature. To change the color temperature, the value of K will need to be changed. To change the brightness without changing the color temperature, the values of $\Delta T_1$ and $\Delta T_2$ need to be changed while the value of K will remain the same. By way of example, for a natural light at 5500K color temperature, 1 KHz frequency, and $\Delta T=0.05$ ms, when at 100% brightness, $t_3+\Delta T=1$ ms, $\Delta T_1=0.45$ ms, $\Delta T_{2=0.45}$ ms. When $\Delta T_1$ and $\Delta T_2$ are changed to $\Delta T_1'=0.3$ ms, $\Delta T_2'=0.3$ ms, the color temperature remains unchanged at 5500K because $K=\Delta T_1'/\Delta T_2'=1$. However, the brightness will be 66.7% of the 100% brightness because $\Delta T_1'/\Delta T_1=0.3/0.45=2/3\approx 66.7\%$.

Figure 9:
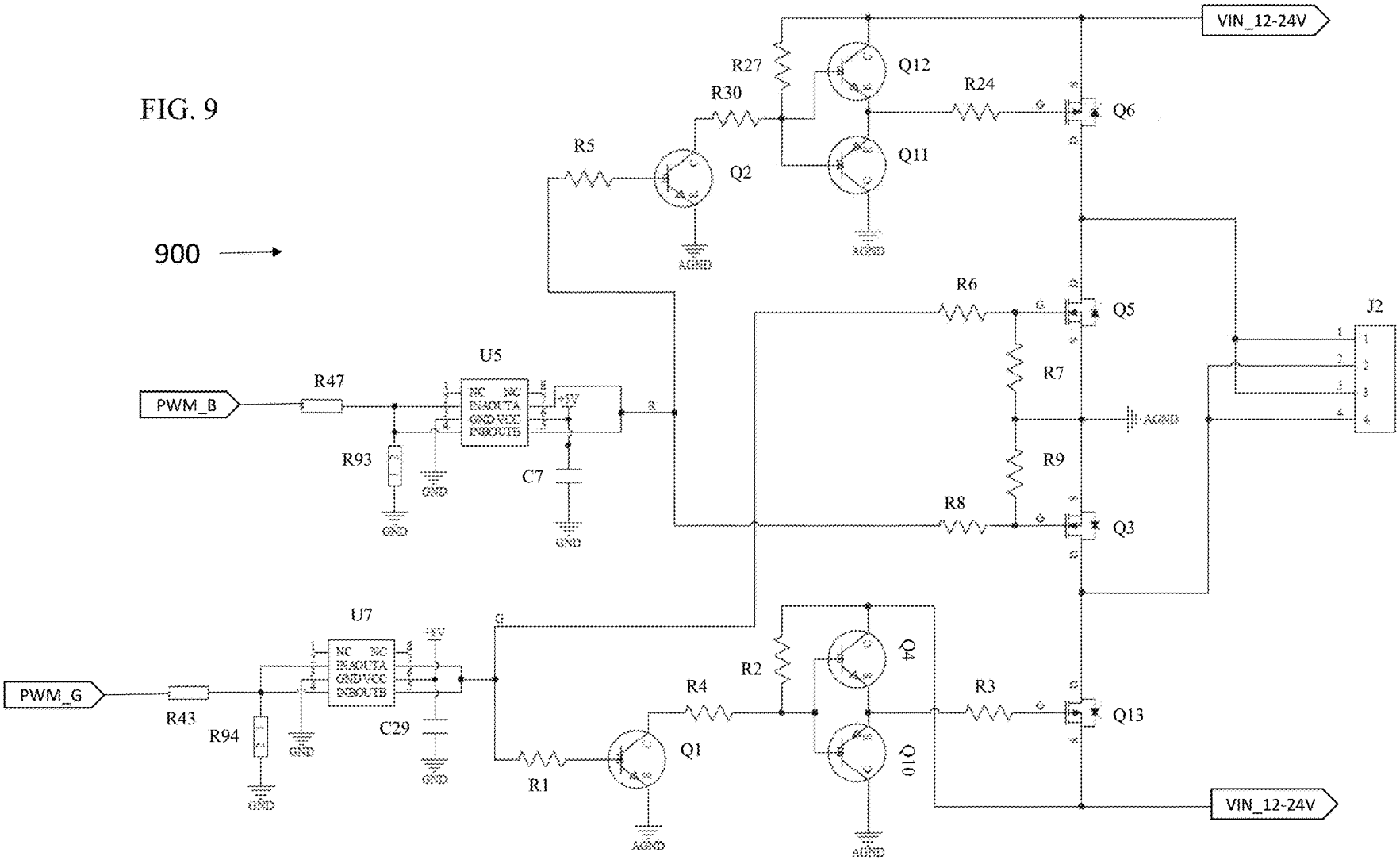
FIG. 9 is a schematic of a driving and dimming circuit for the LED light fixture.

Referring now to FIG. 9, a schematic of an embodiment of an LED driver is provided including dimming color temperature topology circuitry. As shown in FIG. 9, amplified power driving signals (R=+5V and G=+8V) are generated by U5 and U7 (e.g., SGM48000) from the PWM_B and PWM_G signals with an amplitude VDD sent by the MCU (FIG. 7). In other words, the drive signals R and G having stronger driving capability are obtained. The remaining drive circuitry is similar to the LED driver 400 shown in FIG. 4. The specific signal waveform with K=1 is shown in FIG. 10.

Figure 10:
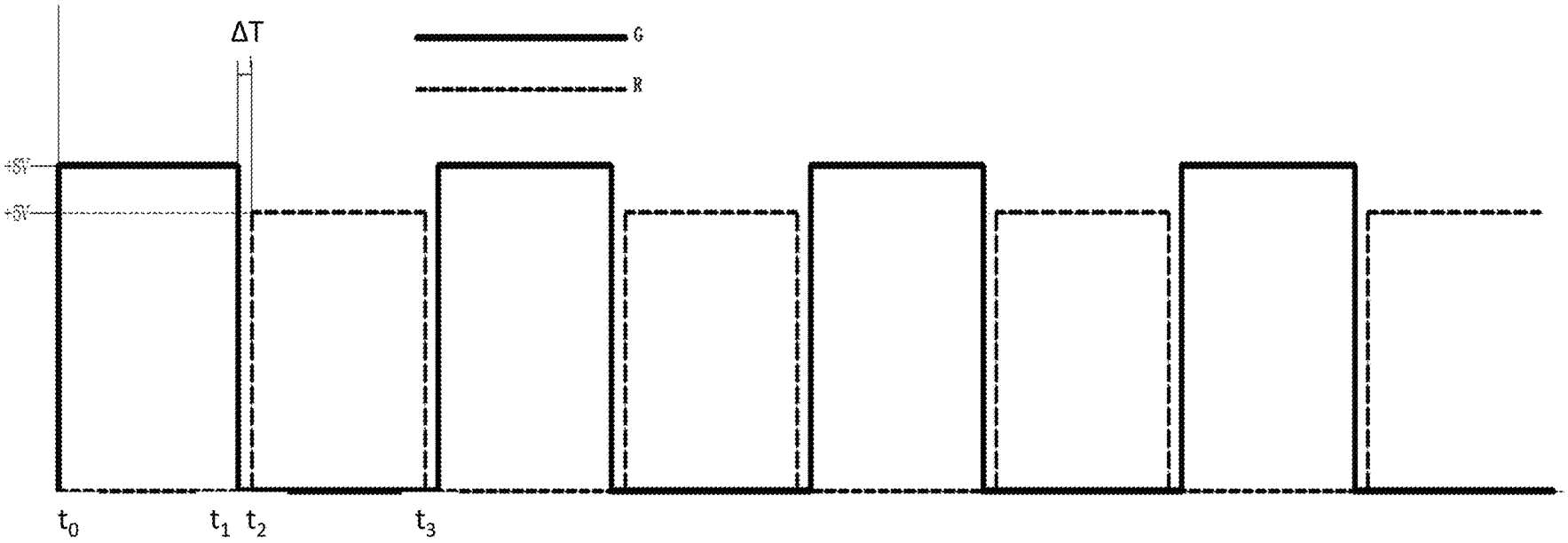
FIG. 10 depicts a waveform of the control signal after power amplification.

Referring now to FIG. 10, exemplary waveforms where K=1 are shown after a power amplification of the MCU control signals. The first and second driving voltage signals of +8V and +5V generated in FIG. 6 are respectively supplied to U7 and U5 (in FIG. 9). The output of U7 is the driving signal G, which is the first driving voltage signal of +8V corresponding to the PWM_G driving, for example, cold white light. The output of U5 is the driving signal R, which is the second driving voltage signal of +5V corresponding to PWM_B driving, for example, warm white light. In this embodiment, $|G|=M$, $|R|=N$, M and N are constants, therefore $M\neq N$. Meanwhile, the time difference $\Delta T$ is maintained when R is turned off and G is turned on, or G is turned off and R is turned on.

Referring now to FIG. 11, an exemplary MOSFET gate drive waveform for controlling lighting up the lamp via the circuit loop Q3, Q5, Q6, Q13 (shown in FIG. 9) is provided. As can be seen, the amplitude of the driving waveforms of Q6 and Q13 changes with the power supply input power to the LED lamp. The amplitude of the driving waveforms of Q3 and Q5 are changed by the driving power supply. Thus, the amplitudes of each of the signals is as follows: $|Q6_G|=|Q13_G|\neq|Q3_G|\neq|Q5_G|$.

Figure 12:
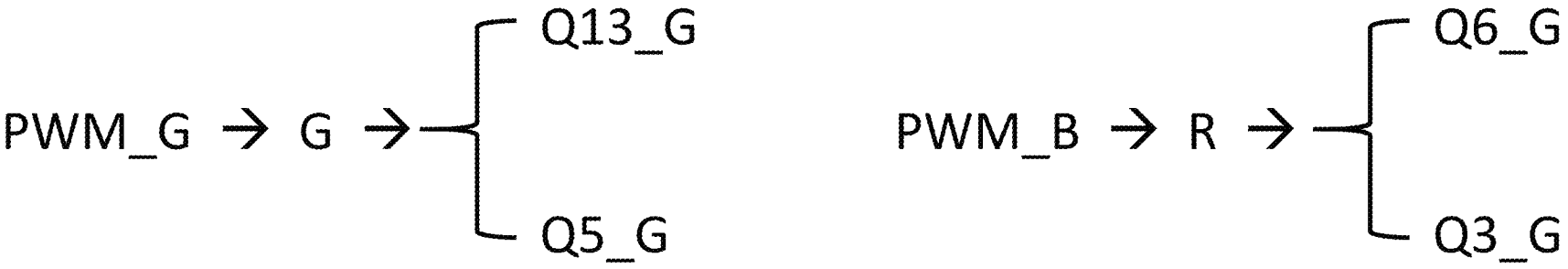
FIG. 12 is an exemplary signal flow.
Figure 13:
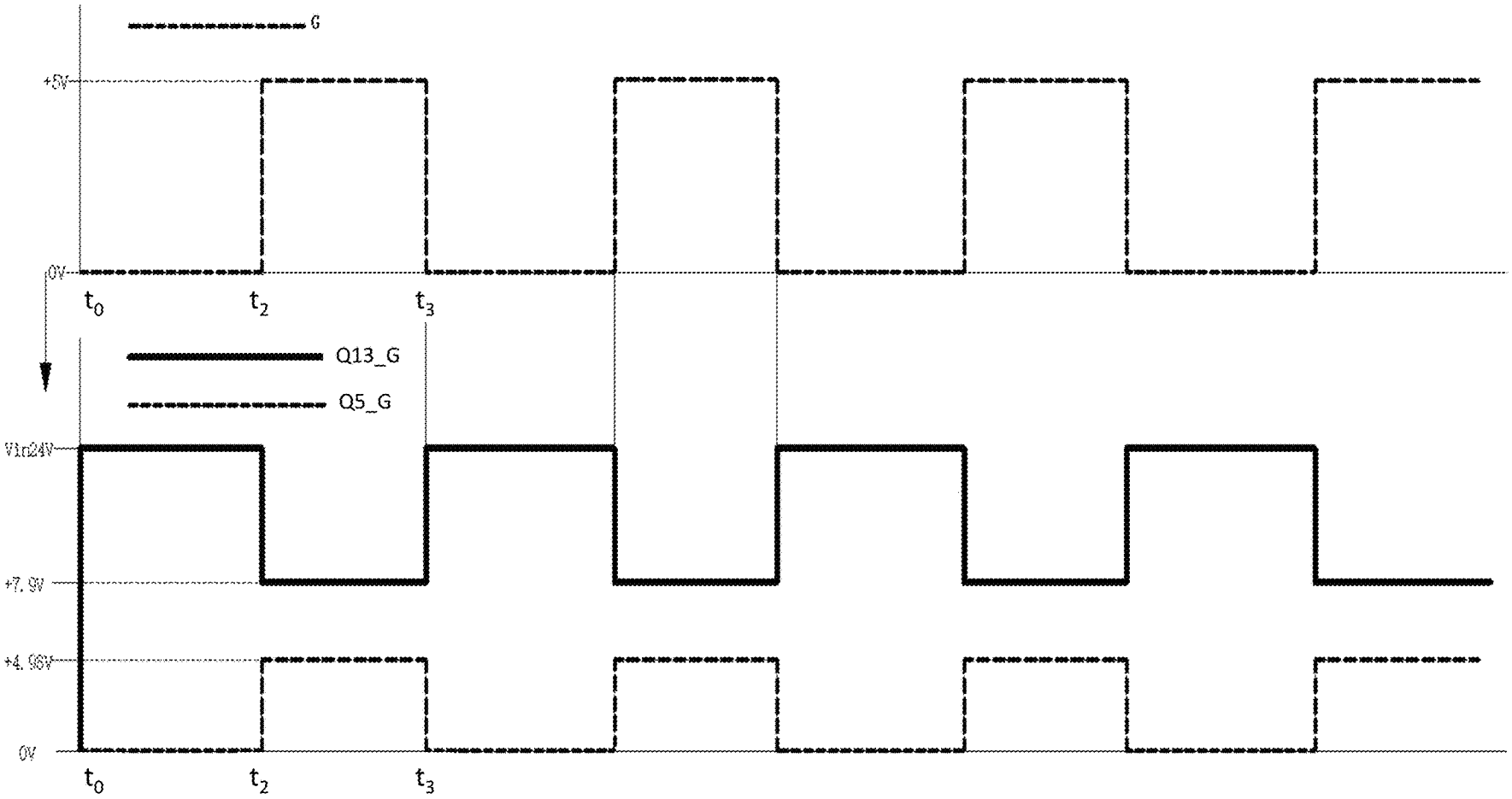
FIG. 13 depicts upper and lower half bridge drive waveforms.
Figure 14:
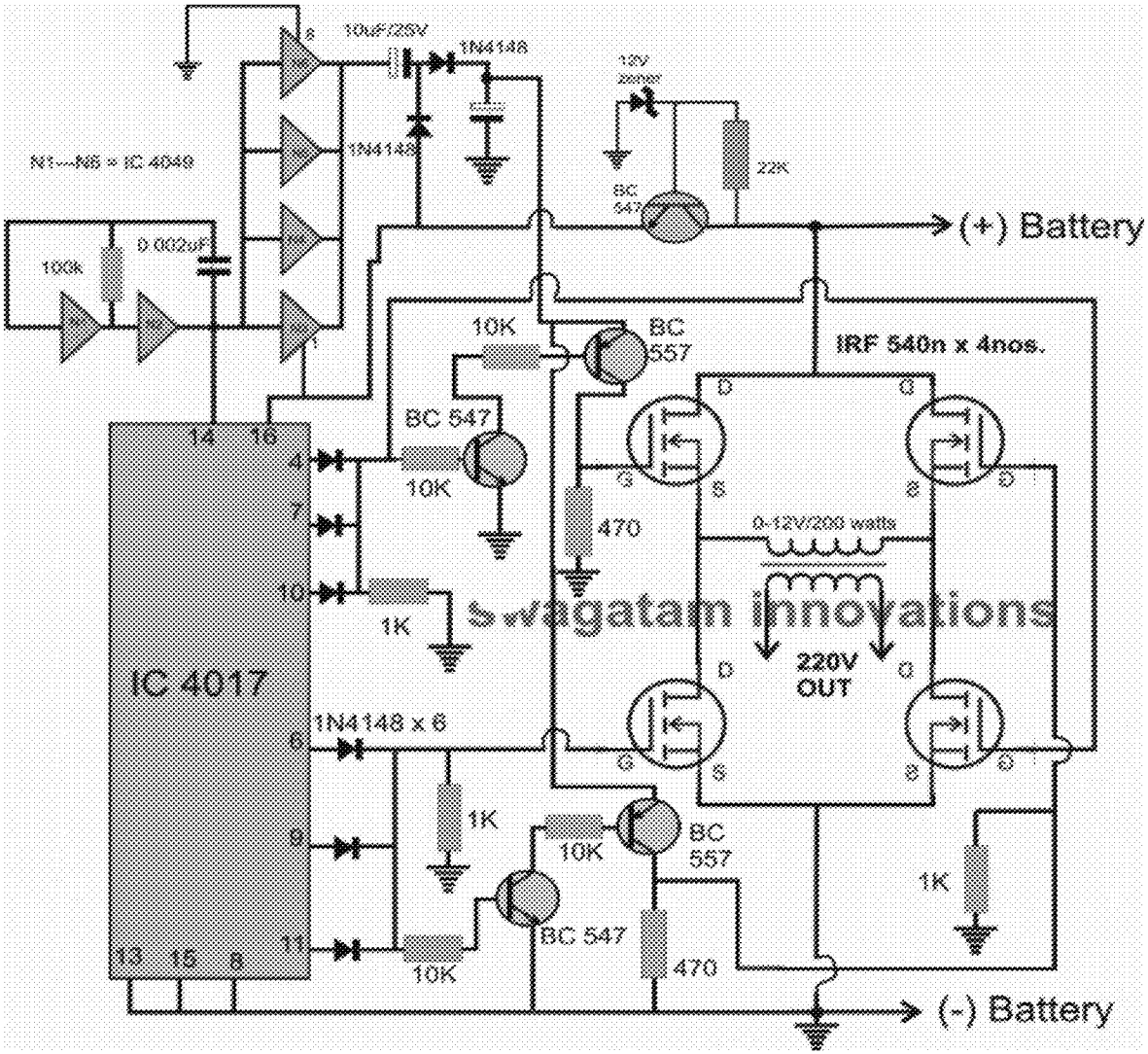
FIG. 14 (prior art)
FIG. 14 is a schematic of a prior art full bridge circuit.
Figure 15:
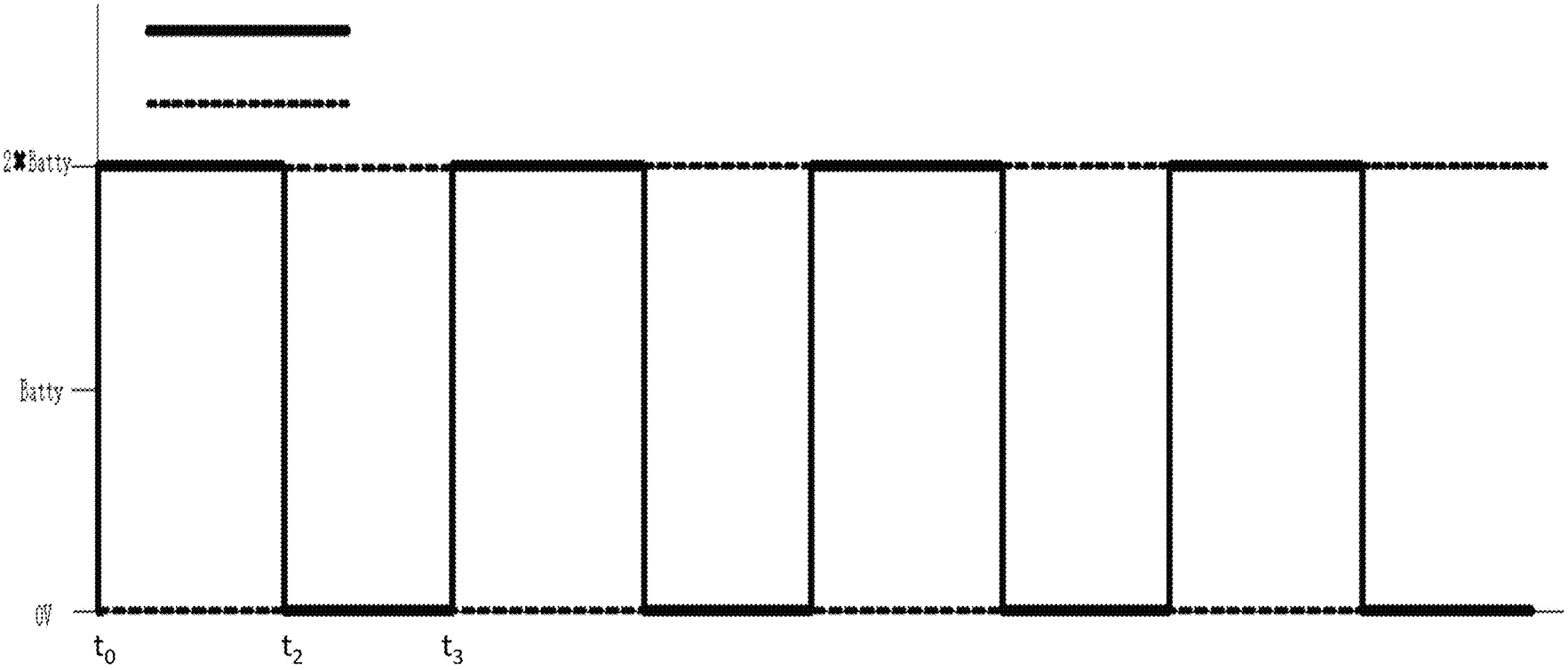
FIG. 15 (prior art)
FIG. 15 depicts the upper half bridge drive waveform of the bridge of FIG. 14.
Figure 16:
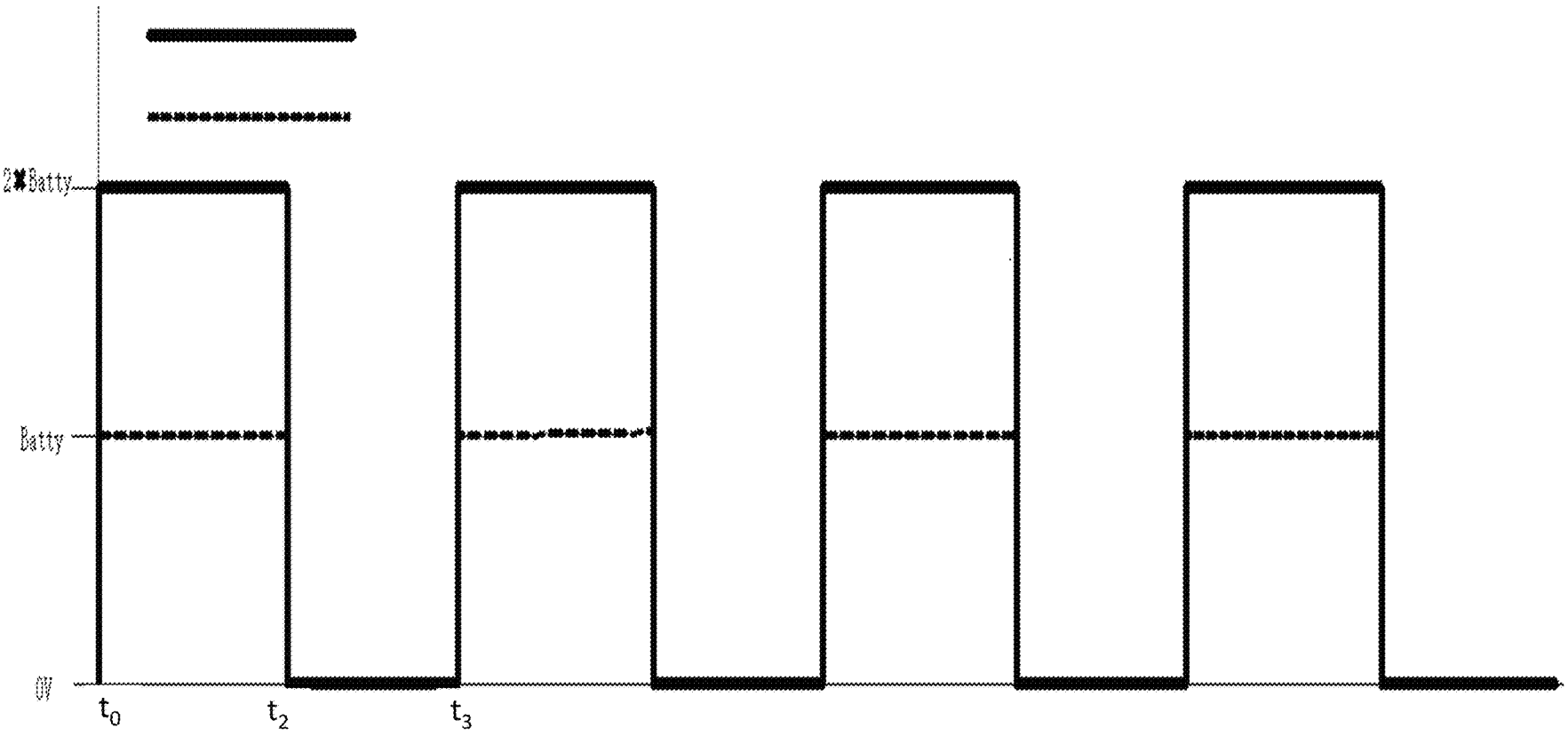
FIG. 16 (prior art)
FIG. 16 depicts the upper half bridge drive waveform of the bridge of FIG. 14.

An exemplary signal flow is shown in FIG. 12. For example, the G signal causes Q5 and Q13 to turn on the cool white light. The driving waveform thereof is shown in FIG. 13. FIG. 13 shows upper and lower half bridge drive waveforms for the same bridge to which the control signal is acquired from the same source. It can be seen that the $V_{in}$ 24V (taking $24V_{dc}$ input as an example) passes through Q13 to the LED lamp string and flows back to the channel from Q5 to GND. The gate drive waveform of Q13 is opposite to the gate drive waveform of Q5, and the amplitude is different. Similarly, the R signal causes Q3 and Q6 to turn on the warm white light.

Returning to the scenario of the embodiment shown in FIG. 9, there are two PMOS transistors and two NMOS transistors. It can be seen that $V_{in}$ (12-24V) is connected to the upper half bridge via the S-pole of the P-channel MOSFET, and the S-pole of the N-channel MOSFET of the lower bridge is coupled to the GND. As can be seen in the drive waveforms of FIG. 13, the upper bridge does not need to add the bootstrap voltage, since the highest amplitude of the waveform is the power supply input power able to turn on the LED lamp, which is in an off state. The lowest amplitude is the circuit design voltage. Taking $V_{in}$=24V DC as an example, the low level amplitude would be approximately 7.9V, which is in an on state.

In combination with the drive control circuitry described above, the benefit of utilizing $\Delta T$ can be seen. Combined with the bridge circuit, when the loop consisting of Q13 and Q5 is switched from on to off, a 24 Vdc is supplied to Q13 (at this moment, the D-pole voltage of Q13 is approximately equal to 24V DC). If there were no $\Delta T$, at the moment of turning on a combination of Q6 and Q3, the D-pole of Q3 is equivalent to being grounded. Which means the $V_{in}$ is being directly grounded and there is a risk of a short circuit. Although the time is short, in high frequency applications, the frequency of it occurring has a risk of reducing the service life of the device and a risk of flashing light. The existence of $\Delta T$ is aimed to improve the service life and stability of the entire system. In view of the above, in various embodiments, the reason for $M\neq N$ is that the opening speed of a MOSFET is positively correlated with the driving voltage, and, thus, the design of $M\neq N$ is to avoid the critical condition of bypassing simultaneous activation and improve the stability of the system.

Although various embodiments of the method and apparatus of the present invention have been illustrated in the accompanying Drawings and described in the foregoing Detailed Description, it will be understood that the invention is not limited to the embodiments disclosed, but is capable of numerous rearrangements, modifications, and substitutions without departing from the spirit and scope of the invention.

What is claimed is:

1. A system to adjust color temperature and brightness of an LED array comprising:

an LED array comprising first and second LED strings having different color temperatures and being connected anti-parallel;

power supply circuitry for converting a power supply input having a DC input voltage into a first driver voltage less than the DC input voltage and a second driver voltage less than the DC input voltage;

a MOSFET transistor bridge connected to the LED array and configured to provide the DC input voltage from the power supply to the LED array via only two wires, the MOSFET transistor bridge comprising a first PMOS (Q13) and a second PMOS (Q6) on a high side of the LED array and a first NMOS (Q3) and a second NMOS (Q5) on a low side of the LED array, wherein a first wire of the two wires connects the first PMOS (Q13) and the first NMOS (Q3) to a supply side of the first LED string and a second wire of the two wires connects the second PMOS (Q6) and the second NMOS (Q5) to a supply side of the second LED string;

a first control module coupled to the first PMOS (Q13) and the second NMOS (Q5), the first control module configured to receive a first control signal and, when the first control signal is high, activate the first PMOS (Q13) and the second NMOS (Q5) to forward bias the first LED string by transmitting the first driver voltage to a gate electrode of the second NMOS (Q5) and inverting the first control signal and transmitting the inverted signal to a gate electrode of the first PMOS (Q13);

a second control module coupled to the second PMOS (Q6) and the first NMOS (Q3), the second control module configured to receive a second control signal and, when the second control signal is high, activate the second PMOS (Q6) and the first NMOS (Q3) to forward bias the second LED string by transmitting the second driver voltage to a gate electrode of the first NMOS (Q3) and inverting the second control signal and transmitting the inverted signal to the second PMOS (Q6);

wherein the color temperature and brightness of the LED light source is configured to be adjusted by periodically switching between the first control signal being high, the second control signal being high, and both the first and second control signals being low; and wherein the second driver voltage is different than the first driver voltage.

2. The system of claim 1, wherein the second driver voltage being different than the first driver voltage ensures the first PMOS (Q13) and the first NMOS (Q3) cannot be activated at the same time and the second PMOS (Q6) and the second NMOS (Q5) cannot be activated at the same time.

3. The system of claim 1, wherein the second driver voltage is less than the first driver voltage.

4. The system of claim 1, wherein the second driver voltage is approximately +5V and the first driver voltage is approximately +8V.

5. The system of claim 1, wherein the second driver voltage being different than the first driver voltage ensures the first NMOS (Q3) and the second NMOS (Q5) will open at different speeds.

6. The system of claim 1, wherein the second driver voltage being different than the first driver voltage ensures the first PMOS (Q13) and the second PMOS (Q6) will open at different speeds.

7. A system for adjusting the color temperature and brightness of an LED light source, comprising:

an LED light source comprising:

a first LED array having an anode end and a cathode end, wherein the first LED array emits light of a first color temperature;

a second LED array having an anode end and a cathode end, wherein the second LED array emits light of a second color temperature; and wherein the first LED array and the second LED array are connected in anti-parallel;

power supply circuitry for converting a DC input voltage from a power supply into a first driver voltage and a second driver voltage, wherein the first driver voltage is less than the DC input voltage and the second driver voltage is less than the first driver voltage;

an LED driver connected to the LED light source for providing the DC input voltage from the power supply to the LED light source via first and second wires, the LED driver being configured to provide the DC input voltage with a first polarity to forward bias the first LED array when a first control signal is high and to provide the DC input voltage with a second polarity to forward bias the second LED array when a second control signal is high;

an LED conduction circuit within the LED driver, the LED conduction circuit comprising a MOSFET transistor H-bridge circuit comprising a first transistor (Q13), a second transistor (Q6), a third transistor (Q3), and a fourth transistor (Q5), wherein the first wire of the LED driver is connected between the first transistor (Q13) and the third transistor (Q3) and the second wire of the LED driver is connected between the second transistor (Q6) and the fourth transistor (Q5);

a first control circuit within the LED driver configured to activate the first transistor (Q13) and the fourth transistor (Q5) when the first control signal is high by transmitting the first driver voltage to a gate electrode of the fourth transistor (Q5) and inverting the first control signal and transmitting the inverted first control signal to a gate electrode of the first transistor (Q13);

a second control circuit within the LED driver configured to activate the second transistor (Q6) and the third transistor (Q3) when the second control signal is high by transmitting the second driver voltage to a gate electrode of the third transistor (Q3) and inverting the second control signal and transmitting the inverted second control signal to a gate electrode of the second transistor (Q6); and wherein the first transistor (Q13) and the second transistor (Q6) are PMOS transistors and the third transistor (Q3) and the fourth transistor (Q5) are NMOS transistors.

8. The system of claim 7, wherein the first transistor (Q13) and the second transistor (Q6) are disposed on the high side of the LED light source and the third transistor (Q3) and the fourth transistor (Q5) are disposed on the low side of the LED light source.

9. The system of claim 7, wherein the LED driver is configured to ensure the first transistor (Q13) and the third transistor (Q3) cannot be activated at the same time.

10. The system of claim 7, wherein the LED driver is configured to ensure the second transistor (Q6) and the fourth transistor (Q5) cannot be activated at the same time.

11. The system of claim 7, wherein the second driver voltage being less than the first driver voltage ensures the first PMOS (Q13) and the first NMOS (Q3) cannot be activated at the same time and the second PMOS (Q6) and the second NMOS (Q5) cannot be activated at the same time.

12. The system of claim 7, wherein the second driver voltage is approximately +5V and the first driver voltage is approximately +8V.

13. The system of claim 7, wherein the second driver voltage being different than the first driver voltage ensures the first NMOS (Q3) and the second NMOS (Q5) will open at different speeds.

14. The system of claim 7, wherein the second driver voltage being different than the first driver voltage ensures the first PMOS (Q13) and the second PMOS (Q6) will open at different speeds.

15. A system to adjust color temperature and brightness of an LED array comprising:

an LED light source having a first input and a second input, the LED light source comprising:

a first LED string having an anode end connected to the first input and a cathode end connected to the second input, wherein the first LED string emits light of a first color temperature; and a second LED string having an anode end connected to the second input and a cathode end connected to the first input, wherein the second LED string emits light of a second color temperature;

power supply circuitry for converting a DC input voltage from a power supply into a first driver voltage and a second driver voltage, wherein the first driver voltage is less than the DC input voltage and the second driver voltage is less than the first driver voltage;

an LED driver connected to the LED light source and configured to provide the DC voltage from the power supply to the LED light source via only two wires, wherein the LED driver is configured to output the DC voltage with a first polarity to forward bias the first LED string in a first mode of operation, output the DC voltage with a second polarity to forward bias the second LED string in a second mode of operation, and disconnect the LED light source from the power supply in a third mode of operation;

an intelligent control unit communicatively coupled to the LED driver for transmitting a first control signal to activate the first LED string during the first mode of operation and transmitting a second control signal to activate the second LED string during the second mode of operation;

wherein the LED driver includes a first control module for receiving the first control signal, a second control module for receiving the second control signal, and an LED conduction module disposed between the first and second control modules and the LED light source;

the LED conduction module comprising a MOSFET transistor H-bridge circuit having first and second PMOS transistors on a high side of the LED light source and first and second NMOS transistors on a low side of the LED light source, the LED conduction module having a first output connected to the first input of the LED light source and a second output connected to the second input of the LED light source;

wherein, in the first mode of operation, the first driver voltage is transmitted to a gate electrode of the first NMOS transistor and, in the second mode of operation, the second driver voltage is transmitted to a gate electrode of the second NMOS transistor; and wherein the intelligent control unit is configured to adjust a color temperature and brightness of the LED light source by periodically switching between the first mode of operation, the second mode of operation, and the third mode of operation using only the first and second control signals.

16. The system of claim 15, wherein the second driver voltage being less than the first driver voltage ensures the first NMOS transistor and the second NMOS transistor will open at different speeds.

17. The system of claim 15, wherein the second driver voltage being different than the first driver voltage ensures the first NMOS (Q3) and the second NMOS (Q5) will open at different speeds.

18. The system of claim 15, wherein the second driver voltage is approximately +5V and the first driver voltage is approximately +8V.

19. The system of claim 15, wherein the intelligent control unit is configured to always switch to the third mode of operation when switching between the first and second modes of operation.

* * * * *